US008286396B2

(12) United States Patent
Brunnhofer et al.

(10) Patent No.: US 8,286,396 B2
(45) Date of Patent: Oct. 16, 2012

(54) PLASTIC PROFILE FOR WINDOW, DOOR AND FACADE ELEMENTS

(75) Inventors: Erwin Brunnhofer, Fuldabrück (DE); Thomas Muster, Kassel (DE); Ferdinand Bebber, Ahnatal (DE)

(73) Assignee: Technoform Bautec Holding GmbH, Kassel (DE)

( * ) Notice: Subject to any disclaimer, the term of this patent is extended or adjusted under 35 U.S.C. 154(b) by 344 days.

(21) Appl. No.: 12/520,311

(22) PCT Filed: Dec. 14, 2007

(86) PCT No.: PCT/EP2007/011025

§ 371 (c)(1),
(2), (4) Date: Aug. 3, 2009

(87) PCT Pub. No.: WO2008/077515

PCT Pub. Date: Jul. 3, 2008

(65) Prior Publication Data

US 2010/0018140 A1 Jan. 28, 2010

(30) Foreign Application Priority Data

Dec. 22, 2006 (DE) ..... 10 2006 061 035

(51) Int. Cl.
*E06B 3/988* (2006.01)
*E04C 2/38* (2006.01)

(52) U.S. Cl. ..... 52/204.71; 52/204.5; 52/656.6; 49/501; 49/504; 49/DIG. 2

(58) Field of Classification Search ..... 52/204.5, 52/204.6, 204.71, 717.05, 656.5, 656.6; 49/501, 49/504, DIG. 2
See application file for complete search history.

(56) References Cited

U.S. PATENT DOCUMENTS 3,486,288 A * 12/1969 Pyne ..... 52/844
3,579,724 A * 5/1971 Toth ..... 425/4 R
3,703,063 A * 11/1972 Budich et al. ..... 52/213

(Continued)

FOREIGN PATENT DOCUMENTS

AT 374 241 B 3/1984

(Continued)

OTHER PUBLICATIONS

English Translation of International Preliminary Examination Report for parent PCT application No. PCT/EP2007/011025.

(Continued)

*Primary Examiner* — Brian Glessner
*Assistant Examiner* — Rodney Mintz
(74) *Attorney, Agent, or Firm* — J-Tek Law PLLC; Jeffrey D. Tekanic

(57) ABSTRACT

A plastic profile for window, door and facade elements includes a plastic profile body, which extends in a longitudinal direction (z), and at least one outer side, which is located outside in a transverse direction (x) perpendicular to the longitudinal direction (z) as viewed in a cross-section (x-y) perpendicular to the longitudinal direction (z). The outer side includes two roll-in protrusions configured such that a reinforcement element is connectable with the plastic profile body by a rolled-in connection. The reinforcement element has at least one of a hollow profile, a partially-open profile and a receptacle portion configured to accommodate a corner connector, wherein at least one of the hollow profile, the partially-open profile and the receptacle portion is disposed between the roll-in protrusions in the rolled-in state.

20 Claims, 6 Drawing Sheets

U.S. PATENT DOCUMENTS

| | | | | | |
|---|---|---|---|---|---|
| 3,798,869 | A | * | 3/1974 | Nipp | 52/742.1 |
| 3,859,754 | A | * | 1/1975 | Budich et al. | 49/425 |
| 3,964,231 | A | * | 6/1976 | Budich et al. | 52/213 |
| 3,989,779 | A | | 11/1976 | Brunnhofer | |
| 4,304,081 | A | * | 12/1981 | Dawson | 52/309.13 |
| 4,395,862 | A | * | 8/1983 | Jager et al. | 52/844 |
| 4,455,800 | A | * | 6/1984 | Hosooka et al. | 52/309.1 |
| 4,524,112 | A | * | 6/1985 | Willert | 428/595 |
| 4,614,062 | A | * | 9/1986 | Sperr | 49/504 |
| 4,642,870 | A | * | 2/1987 | Schulz | 29/509 |
| 5,019,309 | A | | 5/1991 | Brunnhofer | |
| 5,388,372 | A | * | 2/1995 | Zanoni | 49/408 |
| 5,617,695 | A | * | 4/1997 | Brimmer | 52/717.02 |
| 5,694,731 | A | * | 12/1997 | Tonsmann et al. | 52/656.3 |
| 5,768,836 | A | * | 6/1998 | Bachmann | 52/204.51 |
| 5,945,048 | A | | 8/1999 | Ensinger | |
| 5,974,758 | A | * | 11/1999 | Pielmeier | 52/656.2 |
| 6,094,874 | A | * | 8/2000 | Manzella | 52/204.62 |
| 6,145,256 | A | * | 11/2000 | Cittadini et al. | 52/204.7 |
| 6,202,353 | B1 | * | 3/2001 | Giacomelli | 49/504 |
| 6,582,643 | B1 | | 6/2003 | Brunnhofer | |
| 6,668,500 | B1 | * | 12/2003 | Lamberts | 52/204.72 |
| 6,920,726 | B2 | * | 7/2005 | Bielefeld et al. | 52/204.53 |
| 7,104,019 | B2 | | 9/2006 | Brunnhofer | |
| 7,165,367 | B2 | * | 1/2007 | Habicht | 52/407.1 |
| 7,246,466 | B2 | * | 7/2007 | Turner | 49/504 |
| 7,845,135 | B2 | * | 12/2010 | Sibbett | 52/656.9 |
| 7,913,470 | B2 | | 3/2011 | Siodla et al. | |
| 7,987,633 | B2 | * | 8/2011 | Lenox et al. | 49/504 |
| 8,033,597 | B2 | * | 10/2011 | Griffis et al. | 296/201 |
| 2002/0032994 | A1 | * | 3/2002 | Boone et al. | 52/204.5 |
| 2002/0046539 | A1 | * | 4/2002 | Schulz | 52/730.4 |
| 2005/0115193 | A1 | | 6/2005 | Brunnhofer | |
| 2005/0183351 | A1 | | 8/2005 | Brunnhofer | |
| 2006/0026913 | A1 | * | 2/2006 | Turner | 52/204.5 |
| 2008/0196342 | A1 | * | 8/2008 | Franklin | 52/309.1 |
| 2008/0256893 | A1 | | 10/2008 | Siodla et al. | |
| 2009/0313941 | A1 | * | 12/2009 | Siodla | 52/800.13 |
| 2010/0018139 | A1 | | 1/2010 | Brunnhofer | |
| 2010/0175339 | A1 | * | 7/2010 | Moriya et al. | 52/204.5 |
| 2011/0011028 | A1 | * | 1/2011 | Rawlings | 52/656.5 |
| 2011/0283625 | A1 | * | 11/2011 | Lenox et al. | 49/425 |
| 2011/0318094 | A1 | * | 12/2011 | Hensley | 403/217 |

FOREIGN PATENT DOCUMENTS

| | | | |
|---|---|---|---|
| DE | 1 983 744 | U | 4/1968 |
| DE | 78 37 319 | U1 | 4/1979 |
| DE | 27 52 463 | A1 | 5/1979 |
| DE | 30 25 706 | A1 | 1/1982 |
| DE | 32 42 909 | A1 | 5/1984 |
| DE | 196 34 907 | A1 | 9/1997 |
| DE | 297 18 915 | U1 | 3/1998 |
| DE | 197 43 381 | A1 | 4/1999 |
| DE | 198 12 190 | C1 | 8/1999 |
| DE | 200 16 611 | U1 | 12/2000 |
| DE | 100 06 612 | A1 | 8/2001 |
| DE | 201 05 876 | U1 | 10/2001 |
| DE | 10 2004 002 396 | A1 | 8/2005 |
| DE | 10 2004 002 397 | A1 | 8/2005 |
| DE | 203 21 232 | U1 | 8/2006 |
| DK | 1 353 034 | T3 | 11/2008 |
| EP | 0 137 764 | B1 | 9/1987 |
| EP | 0 162 937 | B1 | 9/1988 |
| EP | 0 764 756 | A1 | 3/1997 |
| EP | 0 865 559 | B1 | 8/2002 |
| EP | 1 353 034 | A2 | 10/2003 |
| EP | 1 493 894 | A2 | 6/2005 |
| EP | 1 555 376 | A1 | 7/2005 |
| EP | 1 705 334 | A2 | 9/2006 |
| EP | 1 154 115 | B1 | 11/2006 |
| EP | 1 353 034 | B1 | 7/2008 |
| GB | 2 153 889 | A | 8/1985 |
| JP | S59-44483 | | 3/1984 |
| JP | S58-127886 | | 8/1984 |
| JP | S59-42280 | U | 10/1984 |
| JP | S59-190877 | U | 12/1984 |
| JP | 2004339855 | A | 12/2004 |
| JP | 2005068875 | A | 3/2005 |
| WO | 8403326 | A | 8/1984 |
| WO | 2008071445 | A1 | 6/2008 |

OTHER PUBLICATIONS

Decision of the German Patent & Trademark Office dated Sep. 28, 2010 in Opposition Proceedings against priority DE patent No. 10 2006 061 035.0 with English summary and partial translation.

International Search Report for PCT/EP2007/011025.

Communication from German Patent & Trademark Office dated Oct. 8, 2008 attaching Opposition against German Patent Application No. 10 2006 061 035.0-24.

Sky-Frame Brochure from R&G Metallbau AG with date of Feb. 14, 2003.

Office Action of Japanese Patent Office mailed Aug. 7, 2012 for counterpart JP patent application No. 2009-541857, including English translation thereof and English translation of claims 1-10 examined by the JPO.

* cited by examiner x
y
z
111
112
200
201
202
21
21a
21b
21ba
22
22a
22b
22bb
22c
22ca
22cb
22cc
22cd
23
24
24a
24b
24ba
24aa
25
25a
25b
50
61
62
63
64
121
121a
121b
121aa
122
122a
122b
122c
122ca
124
124a
124aa
124b
125
125a
125b
131
133
133a
133b
133ba
211
212

PLASTIC PROFILE FOR WINDOW, DOOR AND FACADE ELEMENTS

CROSS-REFERENCE

This application is the U.S. national stage filing of International Application No. PCT/EP2007/011025 filed Dec. 14, 2007, which claims priority to German patent application no. 10 2006 061 035.0 filed Dec. 22, 2006.

TECHNICAL FIELD

The present invention relates to a plastic profile for window-, door- and facade-elements.

RELATED ART

Window systems generally are comprised of a wing profile and a frame profile, wherein the wing is glazed and the frame is connected with the building-shell (brickwork). These profiles are, for example, made of wood, steel, aluminum, plastic or combinations of these materials. The diversity of the competing materials is partly based on tradition; however, the factors thermal properties, wind-resistance, maintenance and maintenance costs, aesthetic impression and price are also important for the selection of the material.

Extruded plastic hollow profiles for windows and doors are known in the prior art (e.g., DE 33 19 144A1), in which the hollow profile part has a plurality of hollow chambers that extend along the hollow profile member. Such hollow profile parts are usually made of rigid PVC. One or more of the internal chambers can be filled with foamed plastic (see also EP 1 154 115 B1). The corner connection of window frames made of such hollow profiles is manufactured by welding or by the use of corner connectors, which are adhered in place.

Window systems (e.g. under the designation Corona CT 70 Plus) having foam-free plastic hollow profiles with a plurality of hollow chambers and conventional steel reinforcement are offered by the window manufacturer Schüco of Bielefeld, Germany, wherein steel-reinforced profiles are inserted into hollow chambers. The steel-reinforced profiles are also used for anchoring of fittings. In these window-systems, the attachment of decorative external covers made of aluminum is possible.

Profile members made of plastic-foam for window elements are known from DE 201 05 876 U1, DE 32 42 909 A1 and WO 97/22779 A1, respectively, in which insulating frames (DE 201 05 876 U1) or profile parts made of metal (DE 32 42 909 A1) or also profile parts made of wood or plastics (WO 97/22779 A1) are connected with the core made of plastic foam in different ways. In the PU-foam core known from DE 201 05 876 U1, separate core-profiles are provided in the PU-profile.

A plastic profile component for window and door elements is known from EP 1 705 334 A2, wherein metal profile parts are adhered to, or also rolled into, both outer sides of the plastic profile part, which outer sides form the interior and exterior sides of the window and door element.

Furthermore, aluminum window, door and facade elements, which are comprised of weather-side and interior-side aluminum profiles made of aluminum-plastic-composite profiles, are known, which aluminum profiles are friction-fit/form-fit connected to plastic profiles. In the manufacturing of the components, the profiles are assembled into frames, wherein the corners are mechanically connected via inserted corner connectors. Moreover, composite window, door and facade elements, which are comprised of weather-side and interior-side profiles made of composite profiles using freely-selectable materials, are known, which are friction-fit/form-fit connected to plastic profiles (EP 1 555 376 A1). DE 200 16 611 U1 discloses a reinforced plastic window profile for windows, etc., wherein a U-shaped groove for accommodating fittings, etc. is provided; a reinforcement profile is affixed in the groove.

SUMMARY

It is an object of the invention to provide an improved plastic profile for window, door and facade elements and a reinforced plastic profile having such a plastic profile for window, door and facade elements.

A profile system for windows, doors and facades is enabled by the invention, wherein hollow profiles made of plastic and having rolled-in reinforcements are utilized, which reinforcements are installed in a positionally-precise and longitudinally-fixed manner and which make possible an insulating zone that is a comparatively large proportion of the total constructional depth.

One embodiment of an inventive profile system for windows, doors and facades comprises plastic profiles, preferably made of plastic hollow profiles, and outwardly-disposed reinforcement profiles, preferably made of aluminum, which have an accommodation chamber for corner connection elements precisely positioned relative to the outer surface and which are connected in a longitudinally-fixed manner with the plastic hollow-profile using a roll-in process.

The plastic profile forms an insulating zone and the proportion of the insulating zone relative to the total constructional depth from the interior side to the weather side preferably is 80% or more, even more preferably 90% or more, or even more preferably, 95% or more.

The profiles can be connected, in a manner analogous to aluminum windows, via corner connectors to components such as window, door and facade elements.

A manufacturing method is used for the manufacture of the plastic profiles made of, e.g., rigid-PVC, PA, PET, PBT, PA/PPE, ASA (reinforced or not reinforced) or others, which calibrates the external contour as well as the internal contour in a positionally-precise manner.

A precision can be ensured by the positionally-precise calibration, with which inserted and affixed reinforcements are positioned relative to the external contour with the required low tolerances.

The invention offers several advantages for designing the properties of window, doors and facade elements, in which the reinforced plastic profile is utilized.

a) Thermal Properties

The thermal rating can be determined by the increased proportion of the plastic hollow profiles in the constructional depth and by the configuration, size and partitioning of the interior hollow spaces, as well as the foam filling thereof.

b) Mechanical Properties

The mechanical properties, such as torsional resistance, etc., can be determined by the constructional depth (i.e. the distance between the weather-side and the interior-side reinforcements) and by the configuration, size and cross-sectional area of the reinforcements.

c) Cross-Section

In the cross-section of the profiles, undercuts and geometries of arbitrary complexity for accommodating fitting and locking elements, seals, etc., are made possible by the use of the plastic hollow profiles.

d) Surface and Coloration

The surface and coloration may also be varied in many ways for the differing designs of the weather side and the interior side by the choice and pigmentation of the plastics and/or through the use of decorative elements.

The external contour of the hollow profile is determined by the required functions, such as e.g.:

a) sealing receptacle, sealing stop, fitting receptacle in the closing plane;

b) block surfaces, functional grooves for the glass guide rail, glass seal receptacle, and drainage for the glazing, c) grooves, window sill stop, receptacle for sealing films, etc., for the building shell (brickwork), and d) glossy, colored and weather-proof surfaces of the hollow profile and/or latches for the attachment of decorative profiles made of plastic, wood, aluminum or stainless steel (extruded or rolled) for the external and interior sides.

The reinforcement preferably comprises extruded aluminum hollow profiles having an interior contour for the accommodation of corner connectors (as is usual for aluminum windows) and an external contour having positioning surfaces for the precise fixing of the position in the plastic hollow profile.

The reinforcements can have additional functions such as are required for the threaded connection of T-joints or fittings.

The plastic hollow profiles are preferably comprised of reinforced materials, e.g. PA 66 GF, and include functional elements on the external contour, e.g. for the accommodation of fitting and locking elements, seals, glass guide rails, accommodation of decorative covers and the like.

The plastic hollow-profiles for windows, doors and facades achieve a satisfactory static bearing capacity due to the reinforcement profiles, which are connected in a longitudinally-fixed manner and are preferably formed of aluminum. The reinforcement profiles preferably include a portion that is suitable for the accommodation of corner connectors. Preferably, functional portions for the accommodation of fitting and locking elements, seals, glass guide rails can be integrated into the plastic hollow profile. The reinforcement profiles preferably can be covered with decorative covers. The plastic hollow profiles fulfill application-specific mechanical requirements by selecting a suitable plastic material, e.g. PA 66 GF.

The reinforcement-profiles can be prepared in a suitable manner for the longitudinally-fixed connection with the plastic profile, e.g. by knurling.

BRIEF DESCRIPTION OF THE DRAWING

Further features and utilities will be derived from the description of embodiments with the assistance of the figures. In the figures.

DETAILED DESCRIPTION OF THE INVENTION

Figure 1:
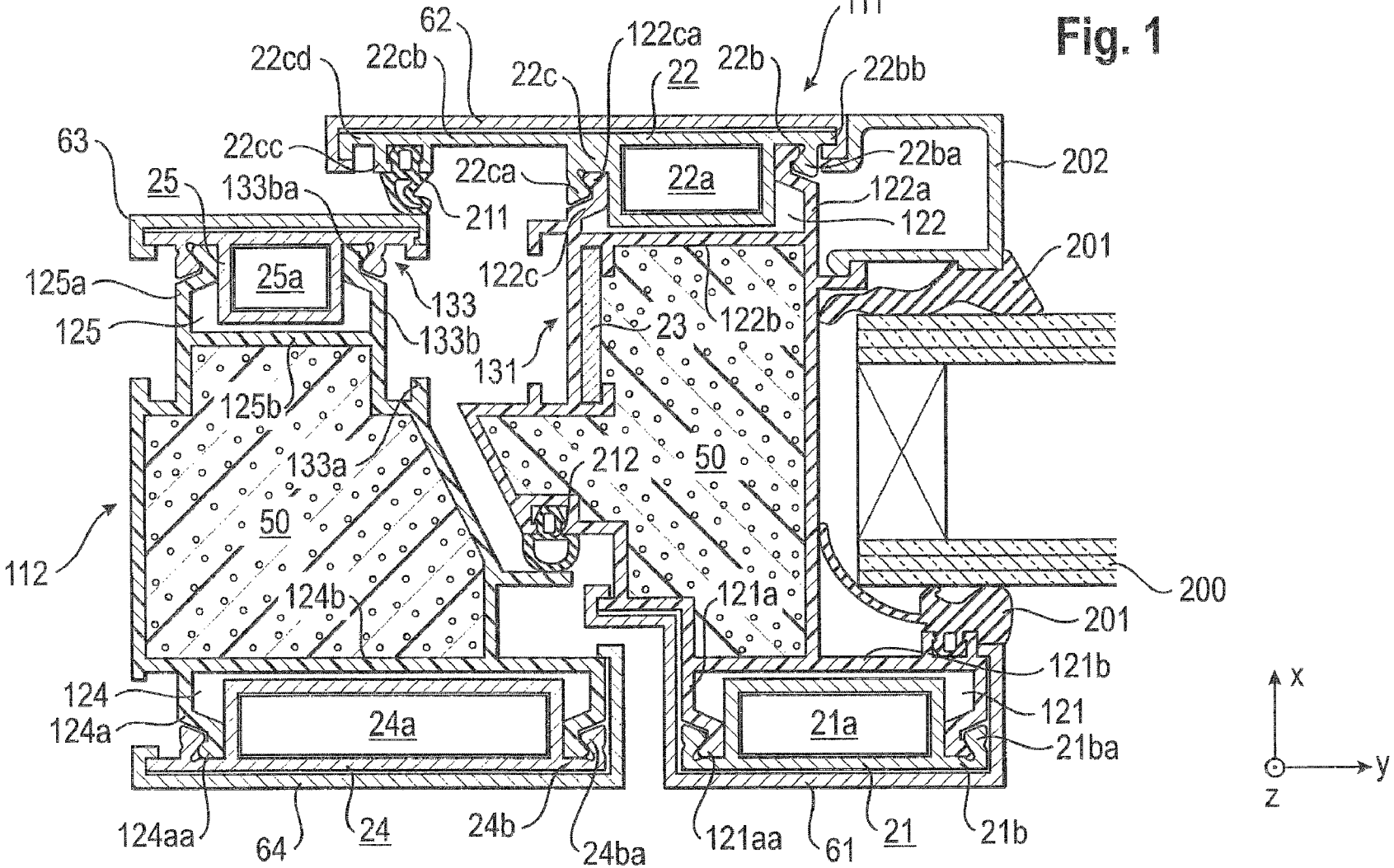
FIG. 1 shows a cross-sectional view perpendicular to the longitudinal direction of a reinforced plastic profile according to a first embodiment of the invention.

A first embodiment of the invention will be described with reference to FIG. 1 and FIG. 6. FIG. 1 shows profile parts as components of a frame profile and of a window wing profile in the cross-section (x-y plane) perpendicular to the longitudinal direction (z) of the respective profile members.

On the right-hand side of FIG. 1, a plastic hollow profile 111 is shown in the cross-section perpendicular to its longitudinal direction, which profile 111 forms a part of a window wing. A double-glass window pane 200 can be retained at/in the frame of the window wing in a known manner via sealing/attachment elements 201, which may also formed in a different shape, and a glass guide rail 202. The top side in FIG. 1 is the interior side and the bottom side in FIG. 1 is the weather side of the profile members.

The plastic hollow profile 111, which forms a part of a window wing, extends in a transverse direction x perpendicular to the longitudinal direction z and perpendicular to a width direction y, which in turn is perpendicular to the longitudinal direction z, from the weather side (bottom side in FIG. 1) to the interior side (top side in FIG. 1). An aluminum hollow profile 21 is affixed to the plastic hollow profile 111 on an external side (weather side) in a manner described below. On the opposite side in transverse direction x, i.e. on the interior side (top side in FIG. 1), an aluminum hollow profile 22 is affixed in a similar manner. A hollow chamber is located between the two outer sides, which in the first embodiment is foam-filled with a foam 50 having a low density. In the cross-section (x-y) perpendicular to its longitudinal direction z, the plastic hollow profile has a complex geometry with undercuts, protrusions and the like for the accommodation of fitting and locking elements (not shown), seals 201, 211, 212, reinforcement rails 23 and other elements such as the window rail 202 and/or for the mounting of decorative elements 61.

The attachment of the aluminum hollow profiles 21, 22 will now be described with reference to FIG. 6 in an exemplary manner for the aluminum hollow profile 21. As can be clearly seen in FIG. 6, the plastic hollow profile 111 includes roll-in protrusions, such as the roll-in protrusions 121*a*, at the respective outer side (in this case the weather side), which protrude from the plastic hollow profile 111 in the transverse direction x and thus form the farthest protruding sections/parts of the plastic hollow profile 111 on this outer side.

The aluminum profile 21 extends in the longitudinal direction z and has a hollow chamber 21*a* surrounded by an outer wall having a rectangular shape in cross-section. The hollow chamber may, of course, also have other cross-sectional shapes, but a rectangular cross-section, the longer side of which extends in the width direction y, is preferred. Protrusions 21*b* extend from the rectangular wall in width direction y; the ends of these protrusions are formed as bendable hammers (roll-in hammers) 21*ba* for rolling-in and form the groove together with another part of the aluminum hollow profile (in this case, the wall of the hollow chamber).

Figure 6:
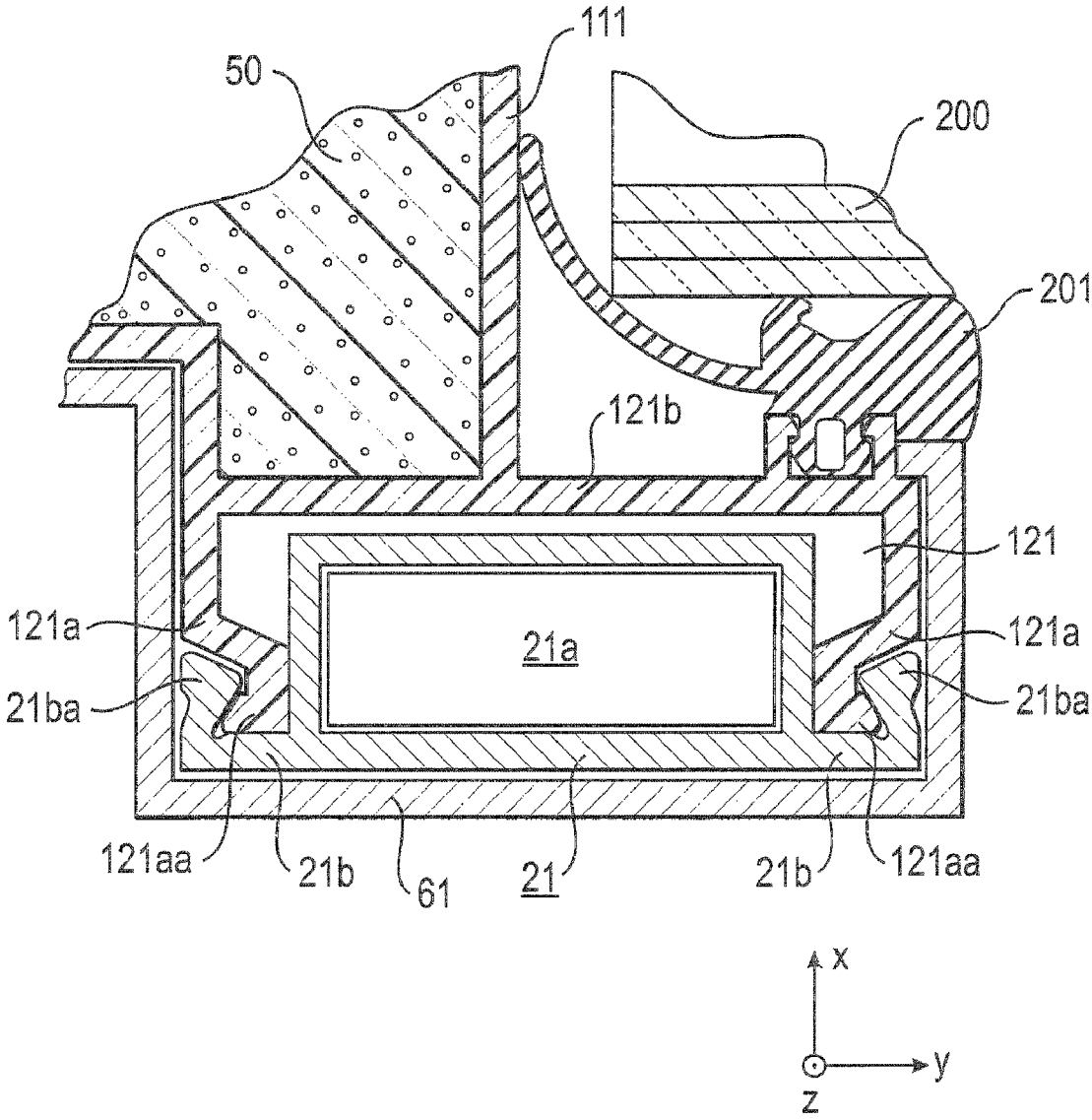
FIG. 6 shows an enlarged view of a portion of the first embodiment from FIG. 1.

As can be clearly seen in FIG. 6, the roll-in protrusions 121*a* of the plastic hollow profile 111 are formed in a suitable bent shape such that the tips, as the heads (roll-in heads) 121*aa* of the roll-in protrusions 121*a*, cooperate with the hammers 21*ba* of the protrusions 21*b* of the aluminum hollow profile 21 to retain the aluminum profile 21 in a longitudinally-fixed manner, and such that the aluminum profile 21 comes into contact with the plastic hollow profile 111 only at the heads 121*aa*. The aluminum profile 21 is accommodated in a receptacle (recess) 121 such that it is surrounded by an air cushion and does not otherwise come into contact with the plastic hollow profile 111. This means that the length of the protrusions 121*a*, i.e., the extension of the protrusion relative to the wall 121*b*, which bounds the receptacle 121, is determined such that the depth of the aluminum profile 21 is less than the length of the protrusions 121*a* in the transverse direction x.

The above explanations for the configuration of the roll-in protrusions and of the aluminum hollow profiles apply to all embodiments.

Figure 4:
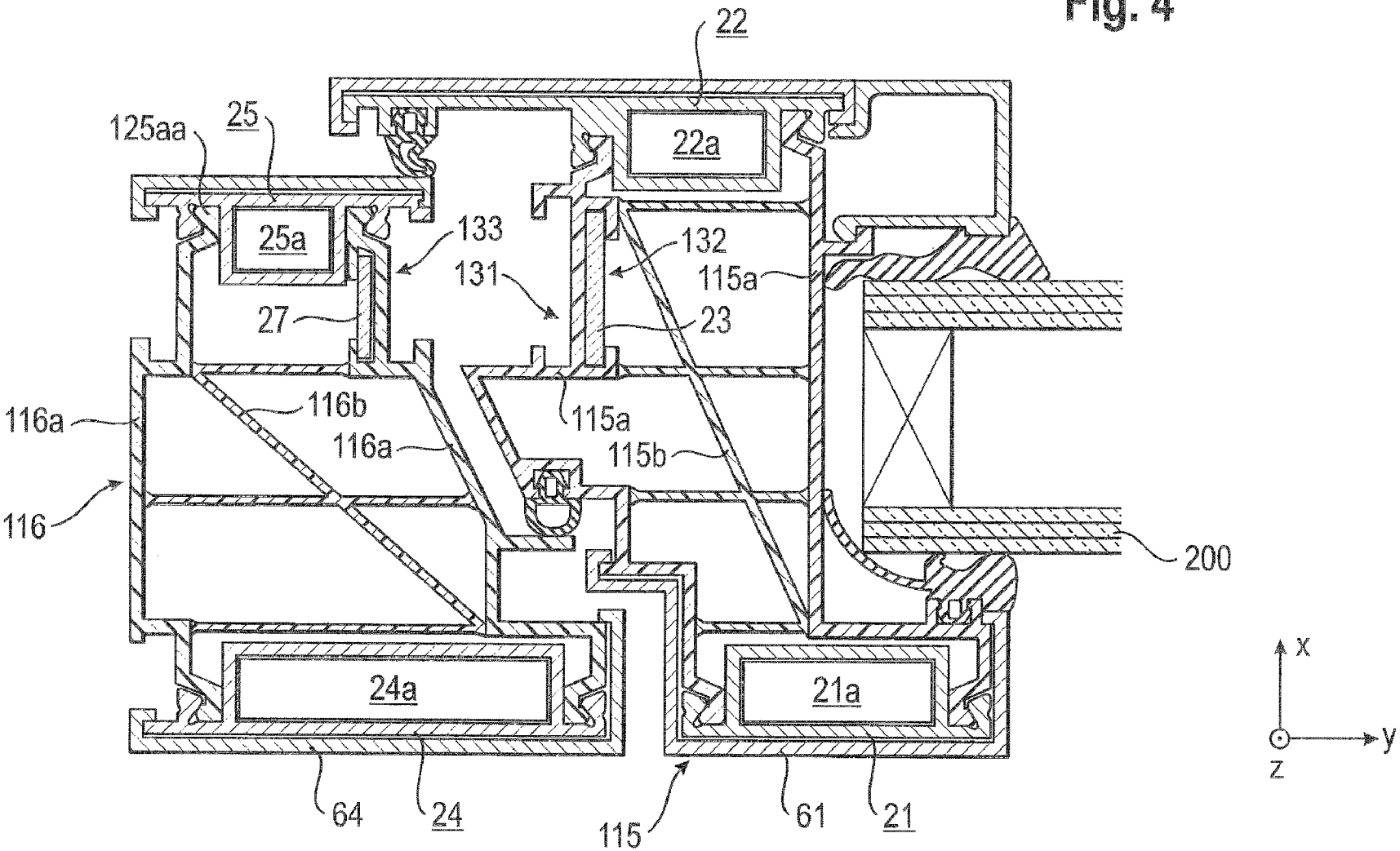
FIG. 4 shows a cross-sectional view perpendicular to the longitudinal direction of a reinforced plastic profile according to a fourth embodiment of the invention.
Figure 5:
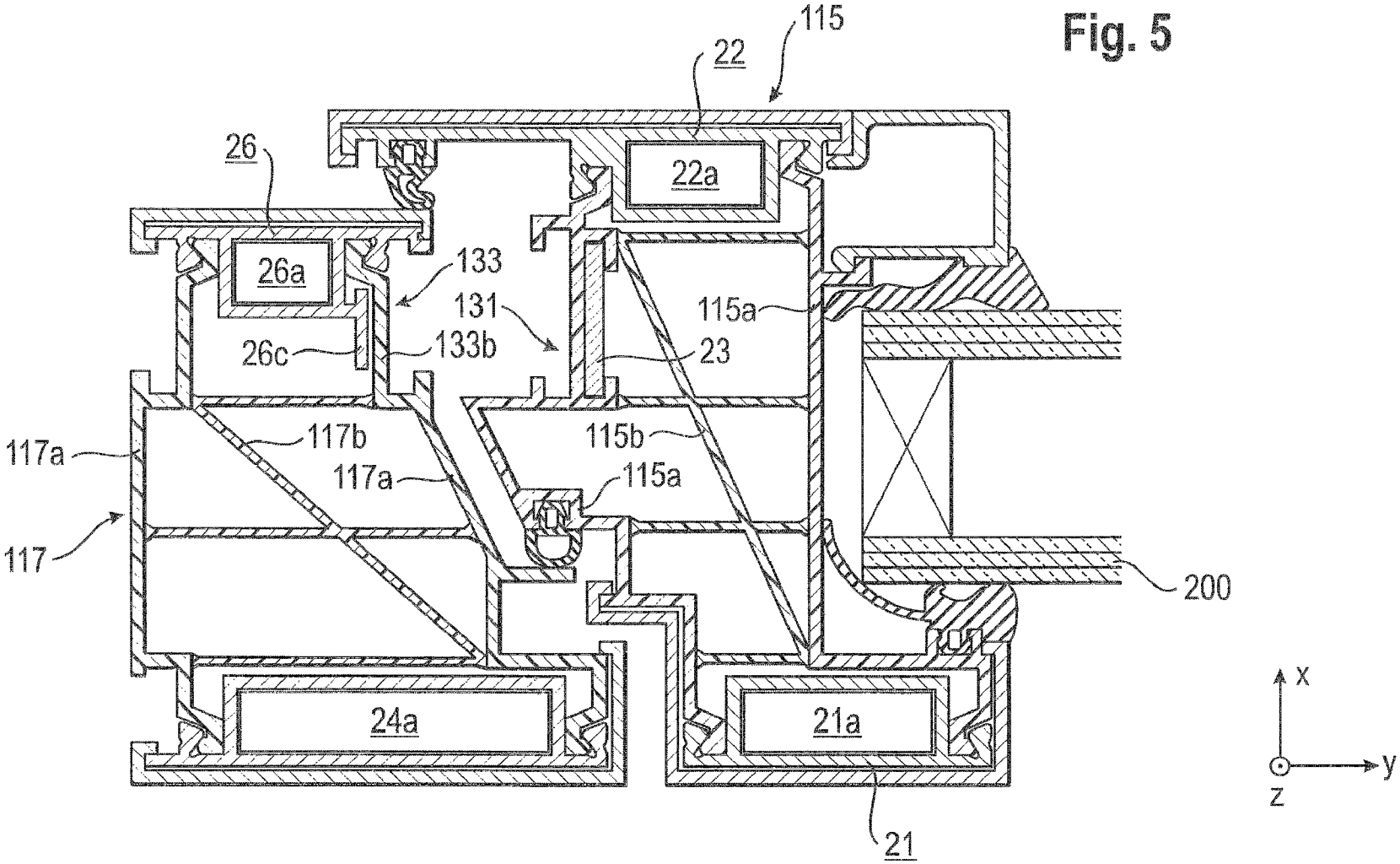
FIG. 5 shows a cross-sectional view perpendicular to the longitudinal direction of a reinforced plastic profile according to a fifth embodiment of the invention.

The wall 121*b* is, in principle, not required for the inside boundary of the receptacle 121, as will be explained further below with reference to FIGS. 4 and 5. However, an inside boundary of the receptacle 121 is provided and preferred in the present first embodiment.

As shown in FIG. 1, the aluminum hollow profile 22 is affixed to roll-in protrusions 122*a*, 122*c* on the opposite outer side (interior side) of the plastic hollow profile 111 in a longitudinally-fixed manner by rolling-in in a similar way. Here, the roll-in protrusions 122*a*, 122*c* are not formed with the same length, which is different than the case of the weather side. However, the roll-in protrusions 122*a* and 122*c* are also the sections/parts of the plastic hollow profile 111 that project the farthest in the transverse direction x on the interior side.

The aluminum hollow profile 22 has a hollow chamber 22*a*, which is surrounded by a wall having a rectangular cross-section, and protrusions 22*b*, 22*c* extending in the width direction y. Unlike in the aluminum hollow profile 21, these protrusions are adapted to realize further functions. For example, the protrusion 22*b* includes another protrusion 22*bb*, in addition to the hammer 22*ba* for rolling-in, which protrusion 22*bb* serves to click-attach a decorative element 62. The protrusion 22*c* includes the hammer 22*ca* for rolling-in and an extension 22*cb*, on which a receptacle 22*cc* for the seal 211 and a protrusion 22*cd* for the click-attachment of the decorative element 62 are provided.

In principle, the aluminum hollow profiles 21, 22 serve as reinforcement elements that are connected to the plastic hollow profile 111 in a longitudinally-fixed manner by rolling-in. In this way, the mechanical properties of a reinforced plastic hollow profile, which is comprised of the plastic hollow profile 111 and the aluminum hollow profiles 21, 22, are achieved.

By constructing a plastic hollow profile 111 such that the roll-in protrusions 121*a*, 122*a*, 122*c* are the farthest protruding sections/parts of the plastic hollow-profile 111 in the transverse direction x, and by disposing the substantial part of the aluminum hollow profile substantially between the roll-in protrusions, or expressed more generally, within the plastic hollow profile, a maximum enlargement of the insulating zone formed from plastic is achieved relative to the total constructional depth in transverse direction x. Different from known composite profiles, the enlargement of the cross-section of the aluminum hollow-profile in transverse direction x is not added to the size of the insulating zone, but rather in the present case the largest part of the enlargement of the cross-section of the aluminum hollow profile in the transverse direction x is within the enlargement of the insulating zone in the transverse direction x, without reducing the enlargement of insulating zone x.

As a result thereof, the proportion of the insulating zone relative to the total constructional depth in the transverse direction x of at least 80%, in the present case (without decorative covers) of even 92% in the case of the plastic hollow profile 111 reinforced with aluminum hollow profiles 21, 22, is achieved. By appropriately modifying the protrusion 22*c* and extending the roll-in protrusion 122*c* to the length of roll-in protrusion 122*a*, even 96% is possible.

The decorative elements 61, 62 can, for example, be formed as aluminum covers that can be clipped onto the profile. Other materials such as stainless steel, wood, plastic, etc. can also be used for the decorative elements 61, 62. It should be considered that the use of a material for the decorative covers that conducts heat very well, especially when the decorative covers extend further in transverse direction x to the inner side of the plastic hollow profile 111, like the decorative cover 61 (in contrast to decorative cover 62), causes a deterioration of the insulating properties, which is, however, much smaller than the improvement achieved through the described connection of the aluminum hollow profiles with the plastic hollow profile. Moreover, these decorative elements can be formed very thin-walled, so that further optimizations are possible here, too.

Figure 2:
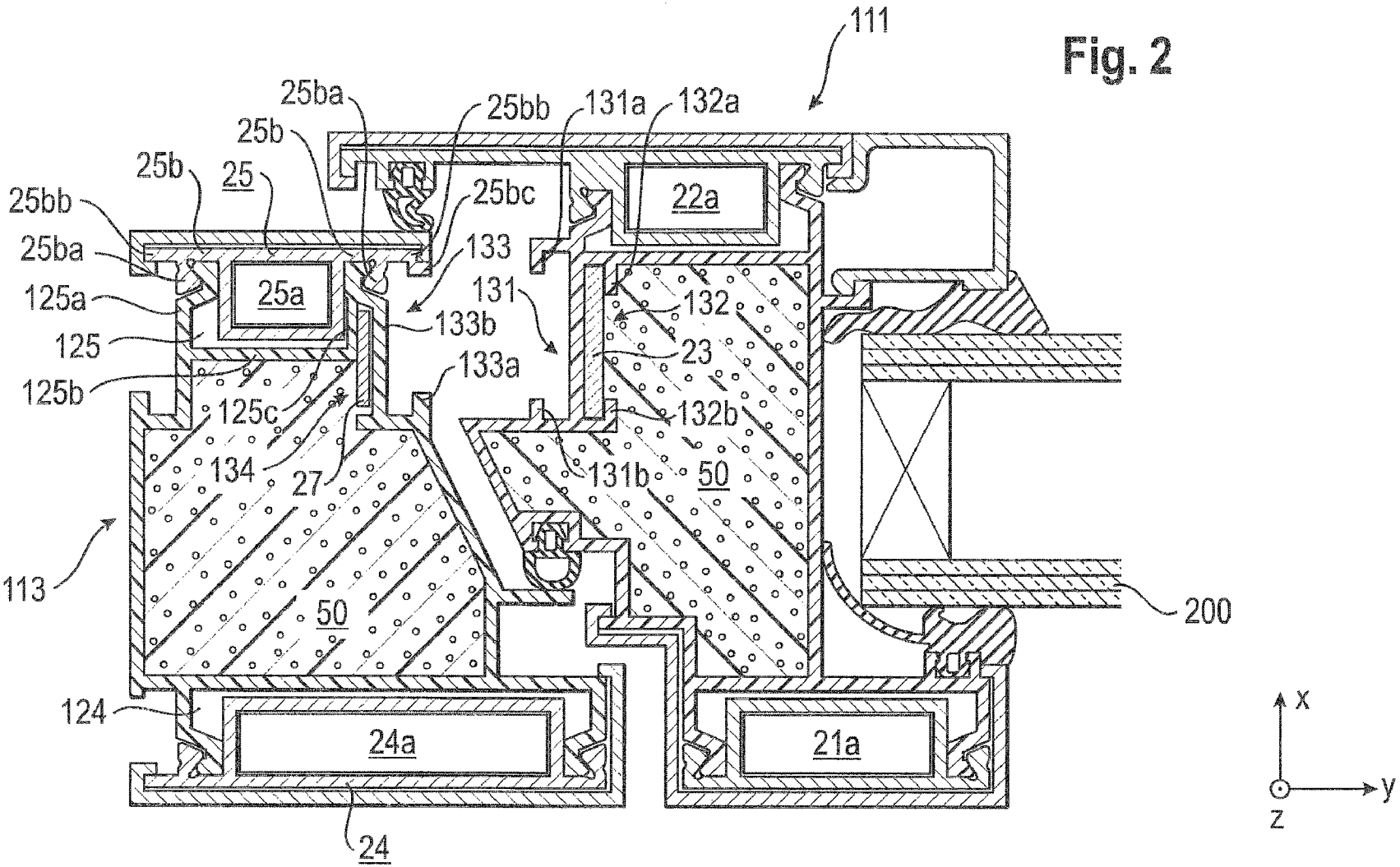
FIG. 2 shows a cross-sectional view perpendicular to the longitudinal direction of a plastic profile according to a second embodiment of the invention.

As was already described above, the plastic hollow profile 111 has a complex geometry. The plastic hollow profile 111, for example, has an undercut recess 131 that is adapted for the accommodation of fittings and locking elements. In the subsequent description, reference to FIG. 2 is made, the plastic hollow profile 111 of which is identical with the plastic hollow profile 111 of the first embodiment. The recess 131 extends in the longitudinal direction z. In the width direction y, the outer wall of the plastic hollow profile 111 forms the back wall of the undercut recess 131. In transverse direction x, the recess 131 is bounded on the interior side by a hook-shaped protrusion 131*a*. In the transverse direction x, on the weather side, the outer wall of the plastic hollow profile 111 extends at a right angle from the part that forms the back wall and includes a protrusion 131*b* protruding towards the interior side, so that the undercut recess 131 is bounded as a whole.

Another undercut recess 132 is formed on the inner side of the back wall of the undercut recess 131. The undercut recess 132 is bounded by the same part of the outer wall of the plastic hollow profile 111 as the back wall in the width direction y. In the transverse direction x, on the weather side, the recess 132 is bounded by a hook-shaped protrusion 132*b* and on the interior side by the outer wall of the plastic hollow profile 111 and by a protrusion 132*a* protruding at a right angle from this outer wall towards the weather side.

The recess 132 forms a receptacle for a reinforcement element (reinforcement bar) 23, whose function is the secure attachment of the fitting and locking elements, which are received in the undercut recess 131 on the outer side. The reinforcement element 23 is held in its position by the foam 50 or in another way (e.g. screws).

The plastic hollow profile 111 of the first embodiment has a hollow chamber that is continuous from the interior side to the weather side. This hollow chamber is foam-filled with the foam 50 for reasons of heat insulation and strength enhancement. Depending on the requirements, the plastic hollow profile can have one or more hollow chambers that are foam-filled entirely, partially or not at all. The density of the foam that is used can be varied depending on the requirements.

On the left hand side of FIG. 1, a plastic hollow profile 112 is shown that is a part of a frame profile. Aluminum hollow profiles 24, 25 are connected in a longitudinally-fixed manner to the plastic hollow profile 112 via roll-in protrusions 124 *a*, 125*a* by rolling-in in the same manner as in the plastic hollow profile 111. The plastic hollow profile 112 also has a hollow chamber that is continuous from the weather side to the interior side, which hollow chamber is foam-filled with a foam 50. In a comparable manner, the aluminum profiles 24, 25 have hollow chambers 24*a*, 25*a* surrounded by outer walls that are rectangular in cross-section. In the hollow profile 112 too, the roll-in protrusions 124*a* together with a corresponding outer wall 124*b* of the plastic hollow profile 112 form a receptacle 124, into which the hollow chamber 24*a* of the aluminum hollow profile is inserted. The aluminum hollow profile 24 is again in contact only with the heads 124*aa* of the roll-in protrusions 124*a* of the plastic hollow profile 112 and is otherwise surrounded by an insulating air layer. The same can be said about the longitudinally-fixed attachment of the aluminum hollow profile 25 by rolling-in, wherein the receptacle 125 is bounded by the roll-in protrusions 125*a* and the outer wall 125*b*. The plastic hollow profile 112 reinforced with the aluminum profile 25 has an undercut recess 133 for accommodation of locking and fitting elements. Different from the undercut recess 131 of the plastic hollow profile 111, this recess is not exclusively formed by the plastic hollow profile, but rather by the combination of the plastic hollow profile 112 with the aluminum hollow profile 25. This means the undercut recess is partly formed by components (outer wall, protrusions) 133*b*, 133*a* of the plastic hollow profile and partly by components (protrusion 25*b*) of the aluminum hollow profile 25. In the embodiment shown in FIG. 1, no reinforcement element for the secure attachment of the fitting and locking elements is provided. It can, however, be made in various ways, as is described with reference to FIGS. 2 and 3.

As can be derived from the description of the first embodiment, the plastic hollow profile makes possible a significant increase of the proportion of the insulating zone out of the total construction depth for comparable constructional depths. This is made possible, for example, by the fact that the roll-in protrusions on the respective outer side are the farthest protruding sections/parts of the plastic hollow profile.

If the reinforcement element is formed with a hollow profile, the hollow profile is to be arranged in a way that it is located substantially (at least more than 50%) within the constructional depth in the transverse direction x, preferably to the largest extent, i.e. 80% or more, more preferably 90% or more, even more preferably completely except for the outer wall, relative to the protruding of the roll-in protrusions, preferably between the roll-in protrusions.

The reinforcement elements and the hollow chambers 21*a*, 22*a*, 24*a*, 25*a*, respectively, of the aluminum hollow profiles can preferably be used as the receptacle portion for accommodating a corner connector.

The aluminum hollow profiles are preferably manufactured by aluminum extrusion, so that the cross-section of the aluminum hollow profiles is identical over the entire length in the longitudinal direction. In this case, the hollow profile and thus also the receptacle portion for the accommodation of a corner connector, is located between the roll-in protrusions in the above described manner.

The reinforcement elements can also be formed as partially-open profiles. In this context, partially-open profile means a profile that has a cross-sectional shape (e.g. a U-shape or the like) in its cross-section (x-y) perpendicular to its longitudinal direction z, which partially, but not entirely, surrounds a space. A further example of a partially-open profile is a rectangular profile that is not completely closed on one side of the rectangle, and the like.

The plastic hollow profiles 111, 112 possess a positionally-precise calibration of the roll-in protrusions relative to the outer geometry of the plastic hollow profiles, so that the aluminum hollow profiles and the receptacle portions for the corner connectors, respectively, can be positioned by means of the longitudinally-fixed rolling-in in a positionally-precise manner relative to the outer geometry. Consequently, a positionally-precise connection of the reinforced plastic hollow profiles via corner connectors or via other corner connections, such as e.g., welding, is possible and the time and effort of the post-processing work of such corner connections is minimized.

In the following, a method for manufacturing the plastic hollow profiles shown in FIG. 1 and FIG. 6 will be described. Methods and devices for manufacturing a hollow chamber profile, with which individual components or the entire hollow chamber profile can be calibrated in a positionally-precise manner, are described in the WO 96/30188 A1 and the DE 199 21 458 A1 respectively. The plastic hollow profiles 111, 112 of the first embodiment are manufactured using suitable methods, wherein materials are chosen that are color-, light- and/or weather-proof, depending on the requirements. In this manufacturing, the profiles are extruded and preferably at least the outer surfaces and the roll-in protrusions are calibrated in a positionally-precise manner. Suitable materials are rigid-PVC, PA, PET, PPT, PA/PPE, ASA, PA66 and others (each with or without reinforcement materials).

The reinforcement parts are preferably manufactured by aluminum extrusion. The protrusions of the reinforcement parts, which have to be rolled-in, are preferably prepared by knurling.

Thermosetting plastics, such as PU, having an appropriate density can be used as foams for foam-filling the plastic hollow profiles. Preferably, foams having a low density (0.01 to 0.3 kg/l) are used. If foam having a high density is to be used, foams with 0.3 to 0.6 kg/l are preferably used.

With the above described embodiment, arbitrary undercuts are possible at arbitrary locations of the profile. The surface treatment of outer and inner covers made of aluminum or other materials can be carried out independent of a foaming process, which is advantageous, in case the foam does not tolerate annealing temperatures. In addition to this advantage, the described embodiment provides a system with excellent mechanical properties, wherein the reinforcement profiles can be used for the corner connection using corner connectors and, at the same time, the necessary post-processing work is minimized. The embodiment also enables the use of foams of different density and the resulting optimization of heat conducting properties.

The described embodiment enables proportions of the insulating zone formed from plastic of 95% or more, in any case of 80% or more of the total construction depth, with excellent mechanical properties that are achieved due to the longitudinally-fixed rolling-in of the aluminum hollow profiles.

A second embodiment is described with reference to FIG. 2. In the second embodiment, the window wing profile is identical to the window wing profile of the first embodiment and therefore the description is not repeated.

The frame profile includes a plastic hollow profile 113 whose design corresponds to the plastic hollow profile 112 of the first embodiment, except for the formation of the recess 125 and the recess 134; a reinforcement element 27 is inserted in the recess 134.

As can be clearly seen in FIG. 2, the outer wall 125*b* does not extend to the outer wall 133*b*, but rather transitions into the wall 125*c* shortly before the outer wall 133*b*; the wall 125*c* forms an outer wall for bounding the receptacle 125. In this way, the undercut recess 134 is formed, which is located at the inner side of the outer wall 133*b* opposite to the undercut recess 133. A reinforcement element 27 is inserted into this undercut recess 134, which reinforcement element 27 serves to securely attach fitting and locking elements that are guided in the undercut recess 133, analogous to the reinforcement 23.

The remaining design of the plastic hollow profile 113 corresponds to the design of the plastic hollow profile 112 of the first embodiment, and therefore, the description is not repeated.

A third embodiment is described with reference to FIG. 3. The window wing profile of the third embodiment corresponds to the window wing profile of the first and second embodiments, and therefore, the description is not repeated here.

The frame profile of the third embodiment differs from the frame profiles of the first and second embodiments in the formation of the receptacle 126 and of the aluminum hollow profile 26.

Figure 3:
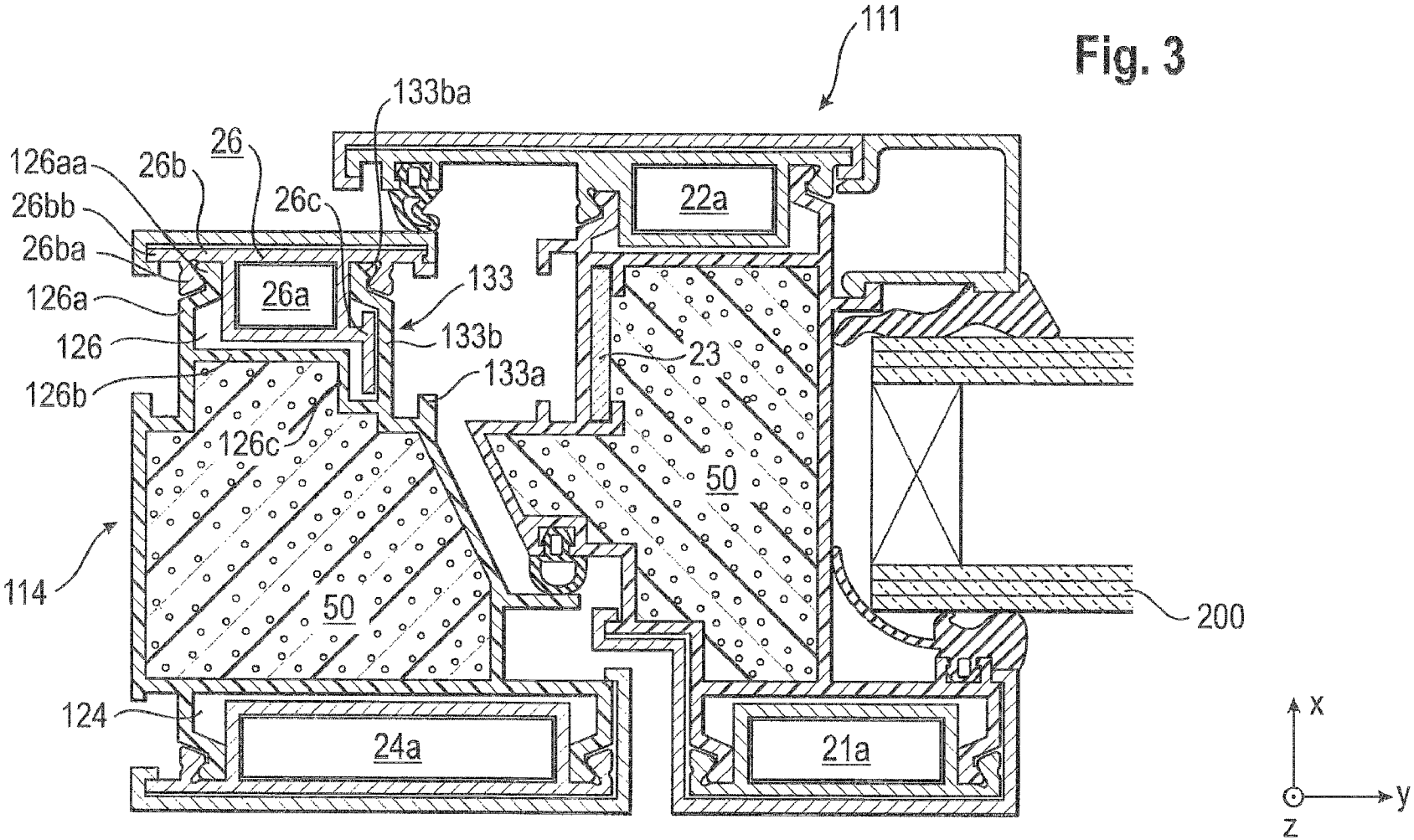
FIG. 3 shows a cross-sectional view perpendicular to the longitudinal direction of a plastic profile according to a third embodiment of the invention.

As can be clearly seen in FIG. 3, the aluminum hollow profile 26 is rolled-in at the interior side of the frame profile in a known manner. The shape of the aluminum hollow profile 26 corresponds to the shape of the aluminum hollow profile 25, except for the protrusion 26*c* that protrudes on the interior side of the aluminum hollow profile 26 in the width direction y and that forms a reinforcement element that extends in the transverse direction x and the longitudinal direction z. A receptacle 126 is bounded by roll-in protrusions 126*a*, the tips 126*aa* of which serve as roll-in protrusions for the protrusions 26*ba* of the aluminum profile 26. For accommodating the reinforcement element 26*c*, the receptacle 126 is provided with a recess extending in the transverse direction x and the longitudinal direction z, which is bounded by a wall 126*c*, so that the reinforcement element 26*c* extends, like the reinforcement element 27, on the inner side of the outer wall 133*b* opposed to the undercut recess 133. Therefore, the reinforcement element 26*c* can fulfil essentially the same function as the reinforcement element 27.

A fourth embodiment is described with reference to FIG. 4.

The fourth embodiment differs from the second embodiment in that the integral plastic hollow profiles 111 and 113 are replaced by multi-part plastic hollow profiles 115 and 116. The remaining design corresponds to the design of the second embodiment. Unlike the plastic hollow profile 111, the plastic hollow profile 115 of the window wing profile is not integrally formed, but rather is formed of a plurality of parts. The outer walls 115*a* are connected via an inner element 115*b* that forms inner bars (e.g. via not-illustrated plug-in, clip-on or other connections). The use of the inner bars 115*b* increases the mechanical rigidity and results in the formation of a plurality of hollow chambers. These hollow chambers can optionally be entirely or partially foam-filled.

The plastic hollow profile 116, which replaces the plastic hollow profile 113 of the second embodiment, is formed in a similar way. This means the outer walls 116*a* are connected via an inner part 116*b* that forms inner bars, wherein a plurality of hollow chambers is formed.

A fifth embodiment will be described with reference to FIG. 5.

The fifth embodiment differs from the third embodiment in the design of the plastic hollow profiles 115 and 117. The window wing profile of the fifth embodiment corresponds to the window wing profile of the fourth embodiment, and therefore, the description is not repeated here.

As compared to the frame profile of the fourth embodiment, the frame profile of the fifth embodiment has an aluminum hollow profile 26 instead of the aluminum profile 25 that is provided in the third embodiment. The plastic hollow profile 117 of the fifth embodiment merely differs from the plastic hollow profile 116 of the fourth embodiment in that no undercut recess for the accommodation of the reinforcement element 27 is formed. Instead, the reinforcement element 26*c*, which is an integral component of the aluminum hollow profile 26, is located on the inner side of the outer wall 133*b* that forms the back wall of the undercut recess 133.

The remaining design of the fifth embodiment corresponds to the design of the fourth embodiment and is therefore omitted.

The manufacturing method described for the first embodiment and the properties and advantages described for the first embodiment are also applicable or are maintained in the second to fifth embodiments. The features of the first to fifth embodiments can be freely combined according to the requirements.

It is explicitly stated that all features disclosed in the description and/or the claims, should be regarded as separate and independent of each other for the purpose of original disclosure as well as for the purpose of restricting the claimed invention, independent of the combination of features in the embodiments and/or the claims. It is explicitly stated that all indications of ranges or of groups of units disclose every possible intermediate value or sub-group of units for the purpose of original disclosure as well as for the purpose of restricting the claimed invention, especially also as a limit of a range indication.

The invention claimed is:

1. A reinforced plastic profile for window, door and facade elements, comprising:

a plastic profile body extending in a longitudinal direction (z) and having first and second outer transverse sides located on opposite sides of the plastic profile body in a transverse direction (x) perpendicular to the longitudinal direction as viewed in a cross-section (x-y) perpendicular to the longitudinal direction (z), and first and second reinforcement elements respectively connected on the first and second outer transverse sides of the plastic profile body by a rolled-in connection, each reinforcement element having a hollow profile portion that is fully-enclosed in the x-y cross-section, wherein two roll-in protrusions are provided on each outer transverse side of the plastic profile body such that the roll-in protrusions are the farthest protruding portions of the plastic profile body on each respective outer side in the transverse direction (x), and the hollow profile portion of the reinforcement element is at least substantially disposed between the two roll-in protrusions in the transverse direction (x).

2. A reinforced plastic profile according to claim 1, wherein:

a first recess is defined on the first outer transverse side between the two roll-in protrusions extending from the first outer transverse side, the fully-enclosed hollow profile portion of the first reinforcement element being substantially completely received in the first recess, a second recess is defined on the second outer transverse side between the two roll-in protrusions extending from the second outer transverse side, the fully-enclosed hollow profile portion of the second reinforcement element being substantially completely received in the second recess, and no portion of the first or second reinforcement element contacts the first or second outer transverse side, respectively, between the respective two roll-in protrusions.

3. A reinforced plastic profile for window, door and facade elements, comprising:

a plastic profile body extending in a longitudinal direction (z) and having at least one outer side located outside in a transverse direction (x) perpendicular to the longitudinal direction as viewed in a cross-section (x-y) perpendicular to the longitudinal direction (z), and at least one reinforcement element having a hollow profile portion that is fully-enclosed in the x-y cross-section, the at least one reinforcement element being connected with the plastic profile body in a longitudinally-fixed manner via two roll-in protrusions provided on the at least one outer side such that at least one of:

(i) the hollow profile portion of the at least one reinforcement element is disposed substantially between the two roll-in protrusions in the transverse direction (x), and (ii) the two roll-in protrusions disposed on the at least one outer side of the plastic profile body are the farthest outwardly protruding portions of the plastic profile body in the transverse direction (x) and, in the rolled-in state, at least one of the hollow profile portion of the at least one reinforcement element is disposed substantially between the two roll-in protrusions in the transverse direction (x).

4. A reinforced plastic profile according to claim 3, wherein the reinforcement element comprises aluminum and has a closed rectangular shape in the cross-section (x-y) perpendicular to the longitudinal direction (z).

5. A reinforced plastic profile according to claim 3, wherein a surface of the reinforcement element that faces the plastic profile body is spaced from the plastic profile body with an air layer in between.

6. A reinforced plastic profile according to claim 3, wherein two bendable hammers respectively extend from opposite sides of the fully-enclosed hollow profile portion in a width direction (y) that is perpendicular to the longitudinal direction (z) and the transverse direction (x).

7. A reinforced plastic profile according to claim 6, wherein the two bendable hammers of the reinforcement element are connected to the two roll-in protrusions of the plastic profile body, respectively, by a plastic deformation of the two bendable hammers of the reinforcement element around the two roll-in protrusions of the plastic profile body, such that the reinforcement element contacts the plastic profile body substantially only at roll-in protrusion contact points.

8. A reinforced plastic profile according to claim 3, wherein the plastic profile body is connected to the first reinforcement element via the roll-in protrusions in a longitudinally-fixed manner by a rolled-in connection.

9. A reinforced plastic profile according to claim 8, wherein an insulating zone is defined in the plastic profile body and has a length in the transverse direction (x) that is at least 80% of the total length of the reinforced plastic profile in the transverse direction (x).

10. A reinforced plastic profile according to claim 9, wherein the insulating zone has a length in the transverse direction (x) that is at least 90% of the total length of the reinforced plastic profile in the transverse direction (x).

11. A reinforced plastic profile according to claim 10, wherein:

a recess is defined on the at least one outer transverse side between the two roll-in protrusions extending from the at least one outer transverse side, the recess being configured to substantially completely receive therein the fully-enclosed hollow profile portion of the at least one reinforcement element, and no portion of the at least one reinforcement element contacts the at least one outer transverse side between the respective two roll-in protrusions.

12. A reinforced plastic profile according to claim 11, wherein two bendable hammers respectively extend from opposite sides of the fully-enclosed hollow profile portion in a width direction (y) that is perpendicular to the longitudinal direction (z) and the transverse direction (x).

13. A reinforced plastic profile according to claim 12, wherein the two bendable hammers of the reinforcement element are connected to the two roll-in protrusions of the plastic profile body, respectively, by a plastic deformation of the two bendable hammers of the reinforcement element around the two roll-in protrusions of the plastic profile body, such that the reinforcement element contacts the plastic profile body substantially only at roll-in protrusion contact points.

14. A reinforced plastic profile according to claim 13, wherein the reinforcement element comprises aluminum and has a closed rectangular shape in the cross-section (x-y) perpendicular to the longitudinal direction (z).

15. A reinforced plastic profile according to claim 14, wherein a surface of the reinforcement element that faces the plastic profile body is spaced from the plastic profile body with an air layer in between.

16. An apparatus comprising:

a structural element selected from the group consisting of a window pane, a door leaf and a facade, and a reinforced plastic profile according to claim 3 connected to the structural element.

17. An apparatus, comprising:

a plastic profile body extending in a longitudinal direction (z) and having first and second outer transverse sides located on opposite sides in a transverse direction (x) perpendicular to the longitudinal direction (z) as viewed in a cross-section (x-y) perpendicular to the longitudinal direction (z), a first reinforcement element having a fully-enclosed hollow profile and two bendable hammers, and a second reinforcement element having a fully-enclosed hollow profile and two bendable hammers, wherein each of the first and second transverse outer sides of the plastic profile body comprises two roll-in protrusions projecting substantially in the transverse and longitudinal directions (x, z) and being separated in a width direction (y) that is perpendicular to the longitudinal direction (z) and the transverse direction (x), the two roll-in protrusions of the first transverse outer side at least substantially accommodate therebetween in the transverse and width directions (x, y) the fully-enclosed hollow profile of the first reinforcement element and the two roll-in protrusions of the second transverse outer side at least substantially accommodate therebetween in the transverse and width directions (x, y) the fully-enclosed hollow profile of the second reinforcement element, and the two roll-in protrusions of the first and second transverse outer sides are respectively connected to the first and second reinforcement elements by crimping the bendable hammers of the reinforcement element at least partially around the respective roll-in protrusions.

18. An apparatus according to claim 17, wherein the two roll-in protrusions are the farthest protruding portions in the transverse direction (x) on each of the respective first and second outer transverse sides of the plastic profile body.

19. An apparatus according to claim 18, wherein at least one interior chamber is defined within the plastic profile body in the transverse direction between the first and second outer transverse sides, the at least one interior chamber being one of at least substantially hollow and at least partially filled with a foam material.

20. An apparatus according to claim 18, wherein the first and second reinforcement elements each comprise aluminum and each reinforcement element contacts the plastic profile body only at respective terminal end portions of the roll-in protrusions.

* * * * *